343-909 SR
9/8/81 XR 4,288,337

United States Patent [19]
Ota et al.

[11] 4,288,337
[45] Sep. 8, 1981

[54] LIGHTWEIGHT MATERIALS HAVING A HIGH DIELECTRIC CONSTANT AND THEIR METHOD OF MANUFACTURE

[75] Inventors: Hiroshi Ota, Tokyo; Noboru Sakuma, Kamakura; Takeki Takarabe; Isao Takiguchi, both of Tokyo, all of Japan

[73] Assignee: Tokyo Keiki Company Limited, Tokyo, Japan

[21] Appl. No.: 71,690

[22] Filed: Aug. 31, 1979

[30] Foreign Application Priority Data

May 2, 1977 [JP] Japan ..... 52-50958

[51] Int. Cl.[3] ..... H01B 3/02
[52] U.S. Cl. ..... 252/512; 252/513; 252/514; 343/911 R; 343/911 L; 343/909; 343/758; 264/45.3; 264/DIG. 17; 264/DIG. 10; 264/DIG. 6; 428/406; 260/375 B; 260/37 EP; 260/37 M; 521/55
[58] Field of Search ..... 252/63.2, 63.5; 343/911 R, 911 L, 909, 758; 264/45.3, 45.4, DIG. 17, DIG. 10, DIG. 9, DIG. 6, DIG. 7; 428/406

[56] References Cited

U.S. PATENT DOCUMENTS

| | | | |
|---|---|---|---|
| 2,716,190 | 8/1955 | Baker | 343/911 R X |
| 2,883,347 | 4/1959 | Fisher et al. | 252/63.2 X |
| 3,079,289 | 2/1963 | George et al. | 252/63.5 X |
| 3,088,713 | 5/1963 | Gard | 264/DIG. 10 X |
| 3,243,483 | 3/1966 | Marshall | 343/911 R X |
| 3,255,453 | 6/1966 | Horst | 343/911 R X |
| 3,256,373 | 6/1966 | Horst | 343/911 L X |
| 3,470,561 | 9/1969 | Horst | 343/911 R |
| 3,507,940 | 4/1970 | Gard | 343/911 R X |

OTHER PUBLICATIONS

"Eccospheres® Hollow Glass and Ceramic Microspheres Microballoons®", Emerson & Cuming Inc., Canton, Mass., 7-69.

*Primary Examiner*—Mayer Weinblatt
*Attorney, Agent, or Firm*—Haseltine and Lake

[57] ABSTRACT

A lightweight mixed dielectric and a manufacturing method thereof is described, which is prepared by mixing metal-coated expanded particles of plastic, glass or silica, thin-wall metal pipes or metal coated thin-wall plastic pipes and uncoated expanded particles of plastic, glass or silica and then forming the resulting mixture into a desired shape by thermal expansion or by the use of binder with the provision that these uncoated expanded particles are only made of plastic when the forming step is carried out by thermal expansion.

12 Claims, 11 Drawing Figures

LIGHTWEIGHT MATERIALS HAVING A HIGH DIELECTRIC CONSTANT AND THEIR METHOD OF MANUFACTURE

This is a Continuation-In-Part Application of U.S. Pat. No. Application Ser. No. 897,538, filed Apr. 17, 1978, now abandoned.

BACKGROUND OF THE INVENTION

The present invention relates to mixed dielectrics of the type manufactured by mixing materials of different kinds and used in dielectric electromagnetic lenses, dielectric antennas and methods of manufacturing the same.

While expanded polystyrol materials and expanded polyurethane materials have heretofore been used as materials for dielectrics used in dielectric electromagnetic lens reflectors and the like, the dielectric constants of these materials are on the order of 2.5 even in their unexpanded conditions and consequently the desired dielectric constants which may be obtained by changing the expansion ratio of these materials will be about 1.9 at the maximum. If the expansion ratio is decreased in an attempt to obtain higher dielectric constants, the material will be expanded nonuniformly thus making it difficult to produce a homogeneous dielectric. With the known dielectric electromagnetic lens reflectors, the dielectric electromagnetic lens section generally comprises a so-called Luneburg lens whose actual manufacture requires the use of a large number of dielectrics of different dielectric constants, and in the case of the Eaton-Lippmann lens which is also used for the dielectric electromagnetic lens reflectors, the lens is so constructed that the dielectric constant is 1 at the surface of the sphere and the dielectric constant is increased toward the center of the sphere where it becomes infinit thus requiring a greater number of dielectrics of different dielectric constants than in the case of the Luneburg lens. Also dielectrics of relatively large dielectric constants have been used in the antennas of the type employing a dielectric. In these applications, it has been the general practice to mix synthetic resin particles, such as expanded polystyrol or polyurethane particles with burnt particles of a higher-dielectric-constant material, such as titanium oxide or lead zirconate and to change the proportions of these materials to thereby produce a dielectric of any desired high dielectric constant, i.e., a mixed dielectric. Typical forms of these prior art mixed dielectrics are shown in FIGS. 1 and 2. The mixed dielectric shown in FIG. 1 is manufactured by mixing expanded particles 1 of a polystyrol material, for example, with burnt particles 2 of titanium oxide or the like in proper proportions and forming the mixture with the addition of a binder, or alternately it is manufactured by mixing crude particles (pre-expanded particles) of a polystyrol material or the like with burnt particles of titanium oxide or the like in proper proportions, subjecting the mixture to a further thermal expansion and then forming the resulting mixture. A disadvantage of the dielectric manufactured in this way is that the expanded particles 1 or crude particles and the burnt particles 2 differ greatly from each other in specific gravity thus making it difficult to uniformly mix them and thereby making it difficult to produce a desired homogenous dielectric, and another disadvantage is that an increased dielectric constant results in a considerable increase in the weight of the resulting dielectric. On the other hand, the mixed dielectric shown in FIG. 2 is manufactured in the following manner, that is, burnt particles of a higher-dielectric-constant material, such as titanium oxide are added, along with an expanding agent, into pre-expanded crude particles of a polystyrol material or the like during the manufacture thereof and then the mixture is thermally expanded and formed. Thus, while this mixed dielectric is advantageous in that any desired dielectric constant can be obtained by suitably determining the amount of burnt particles and the magnitude of expansion ratio and that a homogeneous dielectric can be obtained, it is still disadvantageous in that the operation of mixing a burnt particle into each crude particle presents a manufacturing difficulty and that an increased dielectric constant results in an increase in the weight of the dielectric as in the case of the one shown in FIG. 1.

A further disadvantage of the prior art mixed dielectric is that since the dielectric is produced by mixing a procelain, such as, titanium oxide or lead zirconate with a resin material such as expanded styrol particles, when a considerably high dielectric constant is desired, the amount of such porcelain must be increased considerably in order to obtain the desired dielectric constant, thus increasing the weight of the dielectric. Still another disadvantage is that the increased weight of the dielectric makes the handling of the dielectric lens or antenna more difficult and it also requires the use of mounting means and more rigid construction.

SUMMARY OF THE INVENTION

The present invention is intended to provide a mixed dielectric which overcomes the deficiencies of the prior art mixed dielectrics, e.g., lack of homogeneity in the mixture, the tendency for increased dielectric constant to result in increased weight and Joule loss due to the mixed metallic material and a method for manufacturing the same.

Therefore, it is an object of the invention to provide a mixed dielectric of less weight irrespective of its dielectric constant.

It is another object of the invention to provide a mixed dielectric comprising a mixture of expanded plastic or inorganic microsphere and expanded plastic or inorganic microsphere coated with a thin film of metal, thus attaining a further reduction in weight.

It is still another object of the invention to provide a method of manufacturing a homogeneous mixed dielectric in which the expansion ratio of pre-expanded plastic crude particles is adjusted in such a manner that the pre-expanded plastic crude particles have the same specific gravity as metal-coated particles.

These and other objects, advantages, features and uses will become more apparent upon reading of the following detailed description and drawings.

DESCRIPTION OF THE PREFERRED EMBODIMENTS

An object of the present invention is to provide a mixed dielectric obtained by mixing the expanded particles selected from the group consisting of expanded polystyrols, expanded polyethylenes, expanded polyurethanes, glass balloons and silica balloons, with metal-coated particles consisting of said expanded particles whose surfaces have been coated with a thin film selected from the group of chromium, aluminum, copper, nickel, gold, silver and magnesium in proper proportions to obtain a desired dielectric constant then forming the same to a desired shape by the use of binder. The expanded particles in said dielectric are preferably 0.5 mm to 3.0 mm in diameter.

A further object of the present invention is to provide a mixed dielectric obtained by mixing the expanded particles selected from the group consisting of expanded polystyrenes, expanded polyethylenes, expanded polyurethanes, glass balloons and silica balloons, with thin-wall tubes selected from the group consisting of aluminum, copper and plastic coated with a thin film selected from the group of chromium, aluminum, copper, nickel, gold, silver and magnesium in proper proportions to obtain a desired dielectric constant and forming the same to a desired shape by the use of binder.

The thin-wall aluminum, copper pipes and plastic tubes are preferably from 0.1 mm to 1 mm in diameter and 2 mm to 5 mm in length.

Figure 3:
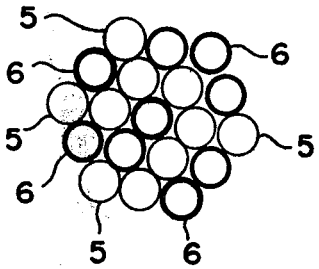
FIG. 3 is a diagram showing the construction of a mixed dielectric in accordance with the present invention consisting of expanded plastic particles and metal-coated particles.

Referring to FIG. 3 showing the construction of a mixed dielectric according to the invention numeral 5 designates expanded hollow bodies of a plastic material, such as polyurethane, polystyrene foams or polyethylene which have been expanded 20 to 30 times, and numeral 6 designates metal-coated particles whose surfaces have been coated, by evaporation deposition process or the like, with a thin film of a conductive light metal, such as chromium, copper or aluminum.

The manufacturing method of the mixed dielectric of the invention shown in FIG. 3 comprises mixing the metal-coated particles 6 and the expanded plastic particles in proper proportions with the addition of a binder, such as, vinyl acetate polymer and then forming the mixture as such to a desired shape.

The expanded particles coated with chromium, aluminum, copper, nickel, gold, silver, magnesium and the expanded particles not coated are mixed so as to obtain the desired specific permissivity, and the desired shape is formed by mixing the binder such as vinyl acetate polymer at a rate of 0.03–0.08 g/cm$^3$.

The expanded particles coated by one of the above metals and the expanded particles without metal coating are mixed so as to obtain the desired specific permissivity then the desired shape is formed by mixing the binder such as silicone rubber, expoxy resin, etc. in it at a rate of 0.03—0.08 g/cm$^3$.

A mixed dielectric for the heat resisting use can be manufactured by the use of metal coated particles and uncoated particles of glass or silica and heat resisting binder. The mixed dielectric of the invention shown in FIG. 3 may be manufactured also by mixing the metal-coated particles 6 and the pre-expanded crude plastic particles in proper proportions and then forming said mixture to a desired shape by thermal expansion.

The dielectric constant of the resulting mixed dielectric is dependent on the proportions of the pre-expanded plastic crude particles and the metal-coated particles 6 and the expansion ratio of the expanded plastic particles 5.

Figure 4:
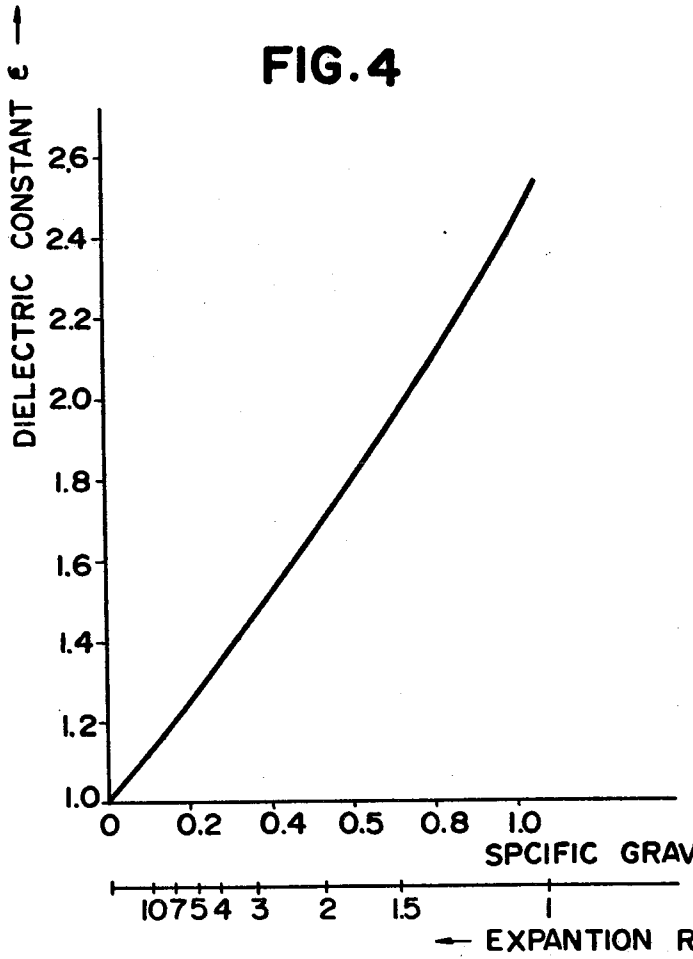
FIG. 4 is a graph showing the relationship between the expansion ratio $\alpha$ and the specific gravity d and dielectric constant $\epsilon$ in a dielectric made from plastic crude particles consisting of a polystyrol material.

FIG. 4 shows the relationship between the expansion ratio $\alpha$ and the dielectric constant $\epsilon$ in a mixed dielectric employing a polystyrol material for the plastic crude particles. The dielectric constant $\epsilon$ is given from the specific gravity d of the plastic crude particles which is dependent on the expansion ratio $\alpha$, as follows:

$$\epsilon = \frac{3d_o + 2d(\epsilon_o - 1)}{3d_o\epsilon_o - d(\epsilon_o - 1)}\epsilon_o$$

where $d_o$=specific gravity of unexpanded plastic crude particles d=specific gravity of expanded plastic crude particles $\epsilon_o$=dielectric constant of polystyrol The graph of FIG. 4 was obtained from the above equation by selecting $d_o$—1.06 and $\epsilon_o$=2.52.

When it is desired to produce the mixed dielectric of the present invention as shown in FIG. 3 by thermal expansion, metal-coated particles and pre-expanded plastic crude particles having a diameter of 0.7–3.0 mm and a desired expansion ratio are mixed in a proper proportion and an expanding agent such as butane, methane, propane and pentane is impregnated in the mixture to be put in a desired mold and heated. But pentane is not usable as an expanding agent for polyurethanes.

The thickness of the metal foil to be coated on the expanded particles is from 2$\mu$ to 6$\mu$ and in the example, nickel plating having the thickness of 3.2$\mu$ was given.

Figure 5:
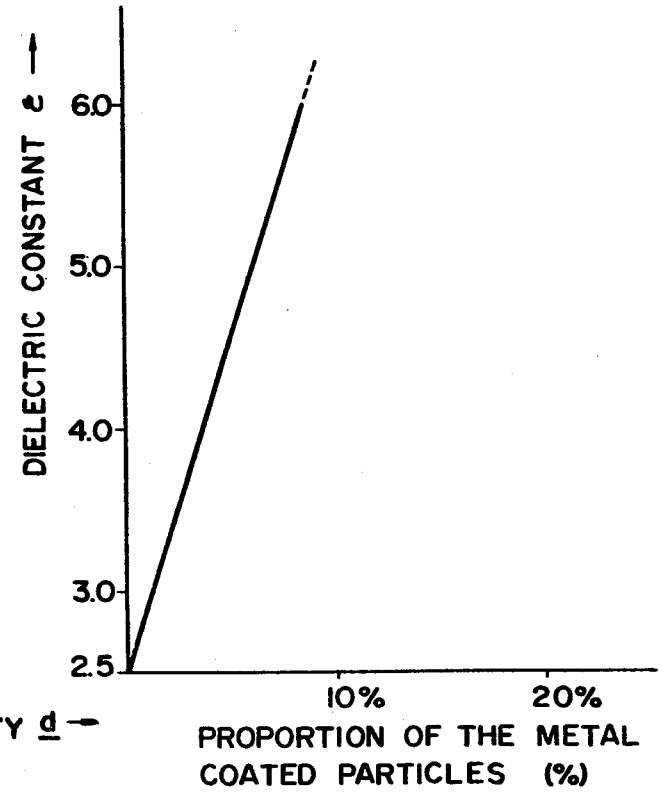
FIG. 5 is a graph showing the relationship between the proportion of the metal coated beads and the dielectric constant in the mixed dielectric according to the invention.

While the proportions of the plastic crude particles and the metal-coated particles for obtaining a desired dielectric constant value may be changed in indefinite ways, FIG. 5 shows by way of example the proportions of these materials for obtaining the required dielectric constants $\epsilon$ for constructing a Luneburg lens which will be described later.

The graph of FIG. 5 was obtained by using the mixed dielectric of the invention produced by mixing as plastic crude particles a polystyrol material having a specific gravity of about 1.06 and metal-coated particles having a specific gravity of about 0.44 and consisting of chromium-coated silica-balloons which will be described later, and the relation between the proportion (5) of the metal-coated particles and the dielectric constant $\epsilon$ is such that the value of the dielectric constant $\epsilon$ represented by the ordinate linearly increases with a predetermined slope as the proportion of the metal-coated particles represented by the abscissa is increased.

Figure 6:
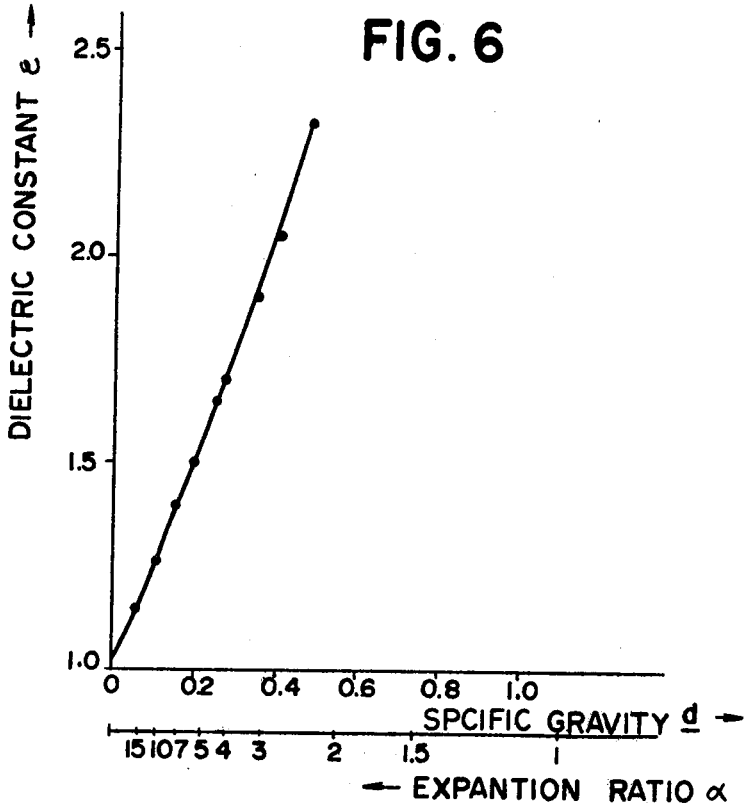
FIG. 6 is a graph showing the relationship between the expansion ratio $\alpha$ and the specific gravity and the dielectric constant $\epsilon$ in the mixed dielectric material of FIG. 5 in which the proportion of the metal-coated particles is 7%.

FIG. 6 shows the relationship between the expansion ratio $\alpha$ and the dielectric constant $\epsilon$ and the specific gravity d of the mixed dielectric containing 7% of metal-coated particles as shown by the graph of FIG. 5 and manufactured as an expandable dielectric material, and this also is used as the material for the Luneburg lens.

In other words, according to the relationship shown in FIG. 6, as the expansion ratio $\alpha$ is increased, the specific gravity d is decreased exponentially and the dielectric constant $\epsilon$ is also decreases almost linearly. As compared with the graph of FIG. 4 in which only polystyrol was expanded, the graph of FIG. 6 shows that the specific gravity is reduced to about one half for the same dielectric constant.

The thickness of the metal coating on the metal-coated particles 6 is very small and therefore the specific gravity of the metal-coated particles 6 is very close to that of the plastic crude particles. As a result, by adjusting the expansion ratio for preliminary expansion in the manufacture of plastic crude particles, it is possible to make the two materials equal in specific gravity with each other. Thus, by virtue of the fact that the specific gravity of the plastic crude particles can be made very close to or the same with that of the metal-coated particles, the two materials can be mixed in the equal proportion making it possible to produce a mixed dielectric having a homogeneous dielectric constant.

Figure 1:
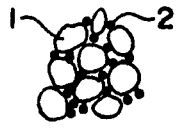
PRIOR ART FIG. 1
FIG. 1 is a diagram showing the construction of a prior art mixed dielectric.
Figure 2:
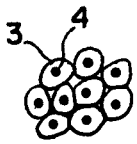
PRIOR ART FIG. 2
FIG. 2 is a diagram showing the construction of another prior art mixed dielectric.

By selecting the diameter of the metal-coated particles 6 in the mixed dielectric to have a value smaller than the wavelength of the electromagnetic wave used, the metal-coated particles 6 act in the same manner as metallic particles of the same diameter on the electromagnetic wave. Consequently, as compared with the prior art mixed dielectrics of FIGS. 1 and 2 employing the burnt particles of titanium oxide, the weight of the mixed dielectric can be reduced greatly for the same dielectric constant.

Figure 7:
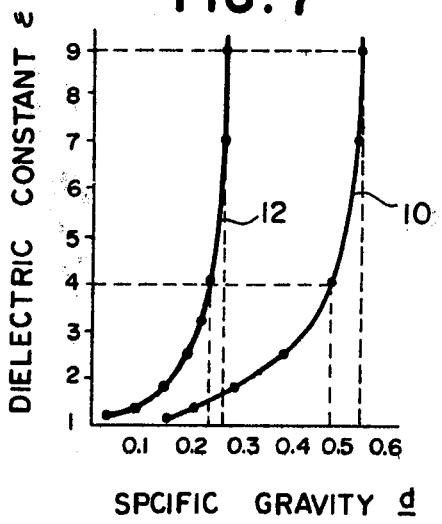
FIG. 7 is a graph showing, in comparison with the prior art mixed dielectric, the relationship between the dielectric constant and the specific gravity in the mixed dielectric of the invention shown in FIG. 3.

FIG. 7 is a graph showing the relationship between the specific gravity and the dielectric constant of a mixed dielectric with the ordinate representing the dielectric constant $\epsilon$ and the abscissa representing the specific gravity d. A curve 10 shows the relationship of the prior art mixed dielectric and a curve 12 shows that of the mixed dielectric according to the invention. As will be seen from FIG. 7, in the case of a mixed dielectric having a dielectric constant $\epsilon$ of 4.0, the corresponding mixed dielectric of this invention has a specific gravity d of about 0.25 which is one half the specific gravity d of the prior art dielectric which is about 0.5, thus showing that the weight of the mixed dielectric of the same dielectric constant is less than that of the prior art mixed dielectric.

In accordance with another embodiment of the invention, the metal-coated particles 6 of FIG. 3 may consist, instead of expanded plastic particles, of inorganic hollow bodies such as silica-balloons or glass balloons whose surfaces are coated with a thin film of metal, or alternately the desired mixed dielectric can be produced by using the expanded plastic particles 5 consisting of similar inorganic hollow bodies, mixing the two materials in proper proportions and then thermally expanding the mixture or forming to a desired shape with the addition of a binder. Since the inorganic hollow bodies and the inorganic hollow bodies coated with a thin film of metal are quite analogous in specific gravity with each other, the two materials can be easily mixed uniformly to produce a mixed dielectric of a homogeneous dielectric constant, and moreover the fact that the metal coating is very thin and the specific gravity of the silica-balloons and the glass balloons is small as compared with that of the conventional metallic particles, has the effect of reducing the weight of the mixed dielectric made according to the invention greatly as compared with the prior art mixed dielectrics.

In accordance with still another embodiment of the invention, the metal-coated particles 6 of FIG. 3 may be replaced with thin-wall plastic pipes whose surfaces have been coated by evaporation with a thin film of metal or thin-wall metal pipes may be used as such in place of the metal-coated particles 6. Many types of plastics can be used in this thin-walled pipe. They include polyvinyl chloride, polystyrol and polyethylene.

In this case, instead of depositing a thin film of metal on the entire surfaces of the expanded plastic particles or thin-wall plastic pipes, they may be coated so as to leave an uncoated surface portion on each particle or pipe. This results in a reduction in the dielectric constant of the metal-coated particles, and thus it is necessary to adjust the proportions of the metal coated particles and the plastic crude particles to compensate for the reduction in the dielectric constant.

Next, exemplary applications of the mixed dielectric produced according to the invention will be described.

Figure 10:
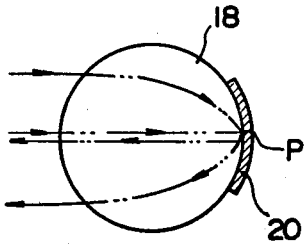
FIG. 10 is a diagram showing a radar reflector employing a Luneburg lens constructed from the mixed dielectric of the invention.

Referring to FIG. 10 showing a radar reflector, numeral 18 designates a Luneburg lens, and 20 a reflecting plate. As is well known in the art and Luneburg lens 18 comprises dielectrics having different dielectric constants $\epsilon$ and arranged in a plurality of layers from the center of the lens toward the outer surface, and more specifically the Luneburg lens 18 is an electromagnetic lens in which the dielectric constant $\epsilon$ at the center portion is 2.0 and the dielectric constant $\epsilon$ at the outer surface is 1.0, that is, the dielectric constant $\epsilon$ varies from 1.0 to 2.0 continuously from the center toward the outer surface. The mixed dielectrics of this invention are used as the dielectric materials for the Lungburg lens 18. In this case, the relationship between the normalized radius R and the dielectric constant $\epsilon$ is given by $\epsilon \times 2.0 - R^2$ (where $R = 1.0$ at the outer surface). Thus, to obtain the required dielectric constants $\epsilon$ of the dielectric layers which vary in a stepped manner, the required Luneburg lens 18 of much less weight can be constructed from mixed dielectrics produced by suitably changing the proportions of plastic crude particles and metal-coated particles in the previously mentioned embodiments of the invention.

As shown by the arrows in FIG. 10, the electromagnetic wave incident on the Luneburg lens 18 propagates along an elliptic path within the lens, converges to and is reflected from a point P on the reflecting plate 20, again propagates along an elliptic path within the lens and is reflected back in the incident direction.

Figure 11:
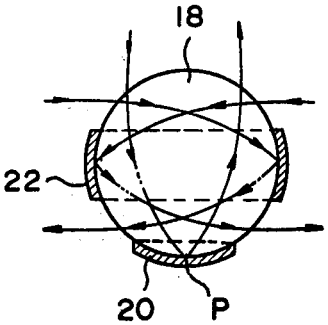
FIG. 11 is a diagram showing another form of the radar reflector employing the Luneburg lens constructed from the mixed dielectrics produced according to the invention.

FIG. 11 shows another embodiment of the radar reflector comprising a Luneburg lens 18 constructed from the mixed dielectrics of the invention, which differs from the radar reflector of FIG. 10 in that band reflecting plates 22 are arranged to cover the sides of the spherical surface in addition to the reflecting plate 20. The provision of these band reflecting plates 22 results in a radar reflector having omnidirectional reflecting properties by which a radio wave received from any direction can be reflected in the incident direction. These radar reflectors are intended for use as marks for salvaging, seamarks, fishing marks and marks for safe navigation of small ships, and the use of the lightweight mixed dielectric according to the invention has the effect of simplifying and facilitating the handling, mounting, etc., of the radar reflector and also reducing the reflection loss of incident radio wave by virtue of the reduced Joule loss owing to the homogeneous dielectric constant.

Figure 12:
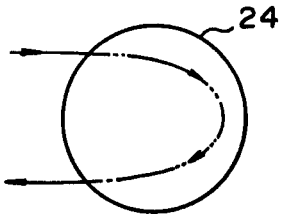
FIG. 12 is a diagram showing a radar reflector consisting of an Eaton-Lippmann lens constructed from the mixed dielectrics produced according to the invention.

FIG. 12 shows an Eaton-Lippmann lens 24 which is shown as a radar reflector using no reflecting plate, and an incident wave on the spherical lens 24 turns along an elliptic path within the lens and is reflected back in the incident direction. With the Eaton-Lippmann lens 24, the relationship between the dielectric constant $\epsilon$ and the normalized radius R is given by $\epsilon=(2-R)/R$, and while it is required theoretically that the dielectric constant $\epsilon$ is 1 at the outer surface and $\epsilon=\infty$ at the center of the lens 24 and that the dielectric constant $\epsilon$ changes continuously from $\infty$ at the center toward 1 at the outer surface, in practice the incident wave can be caused to turn and reflect by laminating dielectric materials of different dielectric constants $\epsilon$ ranging from 20 to 1.

As regards the value of 9.0 for the dielectric constant $\epsilon$ of the dielectric materials from which the Eaton-Lippmann lens 24 is constructed, a comparison in specific gravity between the prior art mixed dielectric and the mixed dielectric of this invention shows that firstly in FIG. 7, for $\epsilon=9$, the specific gravity of the prior art mixed dielectric indicated by the curve 10 is about 0.55 and the specific gravity of the mixed dielectric of this invention indicated by the curve 12 is about 0.275 which is about one half of the former.

Figure 13:
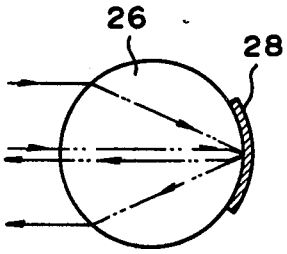
FIG. 13 is a diagram showing a radar reflector consisting of a monostatic lens constructed from the uniform mixed dielectrics produced according to the invention.

FIG. 13 shows a radar reflector in which a sphere or monostatic or bistatic lens 26 is constructed from the mixed dielectrics of the invention so as to substantially uniformly distribute the dielectric constant $\epsilon$ at a predetermined value within the range $\epsilon=3.5\pm\alpha$ (where $\epsilon\neq3.5$), and a reflecting plate 28 is mounted on a portion of the outer surface, thus reflecting the incident wave in the incident direction as shown by the arrows. While the lens 26 must be constructed of uniform materials having the dielectric constants $\epsilon\neq3.5$, the required dielectric materials can be obtained easily by suitably adjusting the proportions of the materials in the mixed dielectric of the invention to obtain the dielectric constants $\epsilon\neq3.5$, thereby ensuring the homogeneous mixing, simplifying the manufacturing operations and ensuring a considerable reduction in weight.

By suitably adjusting the dielectric constant, the mixed dielectric of this invention can also be used in constructing dielectric antennas.

It will thus be seen from the foregoing that by virtue of the fact that metal-coated particles of an expanded plastic or the like are used in place of burnt titanium particles or burnt lead zirconate having a large specific gravity and causing an increased weight, the mixed dielectric of this invention can be greatly reduced in weight and moreover the mixed dielectric of this invention can be made homogeneous by pre-expanding plastic crude particles to have an analogous or identical specific gravity as the metal-coated particles, thus making the mixed dielectric of this invention well suited for constructing electromagnetic lenses, dielectric antennas, radar reflectors and the like.

We claim:

1. A mixed dielectric obtained by mixing the expanded particles selected from the group consisting of expanded polystyrols, expanded polyethylenes, expanded polyurethanes, glass balloons and silica balloons, with metal-coated particles consisting of said expanded particles whose surfaces have been coated with a thin film selected from the group of chromium, aluminum, copper, nickel, gold, silver and magnesium in proper proportions to obtain a desired dielectric constant and then forming the same to a desired shape by the use of binder.

2. A mixed dielectric according to claim 1, wherein the metal films of said metal-coated particles are $2\mu$ to $6\mu$ in thickness.

3. A mixed dielectric according to claim 1, wherein said expanded particles are 0.5 mm to 3.0 mm in diameter.

4. A mixed dielectric according to claim 1, wherein the binder is selected from the group consisting of vinyl acetic polymer, silicone rubber, and epoxy resin.

5. A mixed dielectric according to claim 1, wherein the binder is present in an amount of 0.03 to 0.08 grams per unit volume as expressed in $cm^3$, of the mixed dielectric.

6. A mixed dielectric obtained by mixing the expanded particles selected from the group consisting of expanded polystyrenes, expanded polyethylenes, expanded polyurethanes, glass balloons and silica balloons, with thin-wall tubes selected from the group consisting of aluminum, copper and plastic tubes coated with a thin film selected from the group of chromium, aluminum, copper, nickel, gold, silver and magnesium in proper proportions to obtain a desired dielectric constant and forming the same to a desired shape by the use of binder, said plastic tubes formed from polyvinyl chloride, polystyrene or polyethylene.

7. A mixed dielectric according to claim 6, wherein the metal film of said metal-coated plastic tubes is from $2\mu$ to $6\mu$ in thickness.

8. A mixed dielectric according to claim 6, wherein said thin-wall aluminum, copper and plastic tubes are from 0.1 mm to 1 mm in diameter and 2 mm to 5 mm in length.

9. A mixed dielectric according to claim 6, wherein said expanded particles are 0.5 mm to 3.0 mm in diameter.

10. A mixed dielectric according to claim 6, wherein vinyl acetate polymer, silicone rubber or epoxy resin is used as the binder.

11. A mixed dielectric according to claim 6, wherein the binder is mixed at a rate of 0.03 to 0.08 $g/cm^3$.

12. A manufacturing method of a mixed dielectric obtained by mixing and forming expanded plastic particles selected from the group consisting of expanded polystyrols, expanded polyethylenes and expanded polyurethanes, with metal coated particles consisting of said expanded plastic particles whose surfaces have been coated with a thin film selected from the group of chromium, aluminum, copper, nickel, gold, silver and magnesium, comprising the steps of: pre-expanding plastic crude particles selected from the group consisting of polystyrols, polyethylenes, polyurethanes by adjusting the expansion ratio in such a manner that the resulting pre-expanded plastic particles have the same specific gravity as said metal-coated particles, and mixing said pre-expanded particles and said metal-coated particles in proper proportions to obtain a desired dielectric constant and then forming the same to a desired shape by thermal expansion or by the use of a binder to obtain a material having homogeneous dielectric constant.

* * * * *